US011541515B2

(12) United States Patent
Lorenz

(10) Patent No.: US 11,541,515 B2
(45) Date of Patent: Jan. 3, 2023

(54) MULTIPURPOSE TOOL FOR HANDLES AND VALVES

(71) Applicant: Dennis Neill Lorenz, Raleigh, NC (US)

(72) Inventor: Dennis Neill Lorenz, Raleigh, NC (US)

( * ) Notice: Subject to any disclaimer, the term of this patent is extended or adjusted under 35 U.S.C. 154(b) by 292 days.

(21) Appl. No.: 16/905,281

(22) Filed: Jun. 18, 2020

(65) Prior Publication Data

US 2021/0001458 A1 Jan. 7, 2021

Related U.S. Application Data

(60) Provisional application No. 62/869,207, filed on Jul. 1, 2019.

(51) Int. Cl.

| | |
|---|---|
| ***B25B 13/50*** | (2006.01) |
| ***B24D 15/02*** | (2006.01) |
| ***B25G 1/08*** | (2006.01) |
| ***B25B 23/16*** | (2006.01) |

(52) U.S. Cl.

CPC ..... *B25B 13/50* (2013.01); *B24D 15/02* (2013.01); *B25B 23/16* (2013.01); *B25G 1/08* (2013.01)

(58) Field of Classification Search

CPC ..... B25B 13/50; B25B 23/16; B24D 15/02; B25G 1/08

USPC ..... 7/138

See application file for complete search history.

(56) References Cited

U.S. PATENT DOCUMENTS

| | | | | |
|---|---|---|---|---|
| 1,569,638 | A | 1/1926 | Steele | |
| 2,086,722 | A | 7/1937 | Matuella | |
| 3,010,346 | A | 11/1961 | Kulp | |
| 4,999,875 | A | 3/1991 | Rybak | |
| 5,103,698 | A * | 4/1992 | Delaney | B25B 13/02 81/461 |
| 5,495,641 | A | 3/1996 | Going et al. | |
| 6,076,435 | A | 6/2000 | White, Sr. et al. | |
| 6,186,475 | B1 | 2/2001 | Selepouchin | |
| 6,360,578 | B1 * | 3/2002 | Bresnahan | B25B 13/12 7/125 |
| 6,378,401 | B1 | 4/2002 | Var Lordahl et al. | |
| 6,450,069 | B1 | 9/2002 | Brahmbhatt | |
| 7,013,764 | B2 * | 3/2006 | Leatherby | B25B 13/48 81/176.15 |
| 2003/0047041 | A1 | 3/2003 | Trout | |

(Continued)

FOREIGN PATENT DOCUMENTS

| | | | |
|---|---|---|---|
| GB | 2327255 | A | 1/1991 |

*Primary Examiner* — Hadi Shakeri
(74) *Attorney, Agent, or Firm* — Ashley D. Johnson; Dogwood Patent and Trademark Law

(57) ABSTRACT

A multipurpose tool for handles and valves has been designed to facilitate the operation of outdoor water faucets (sillcocks, cocks, spigots, bibs, taps) and water splitters (diverters, wyes). Metal fingers (pins, tines) on the tool fit into or onto window, tee, and cross tee handles to open or close water faucets. Other metal fingers fit onto various shapes of levers to open or close water splitter valves. The valve fingers also work as a wrench to tighten or loosen the nut securing most faucet handles to the spigot. Both types of fingers can be used to scoop out damaged leaky washers. The tool arm has a metal file surface to smooth rough faucet edges that touch washers, often a place where water leaks occur. Finally, the hollow tool handle contains extra plumbing sealing tape and washers for onsite faucet and hose repairs.

17 Claims, 14 Drawing Sheets

(56) References Cited

U.S. PATENT DOCUMENTS

2007/0256237 A1* 11/2007 Mayer ..... E03C 1/20
81/73
2009/0320651 A1 12/2009 Kramer

* cited by examiner

MULTIPURPOSE TOOL FOR HANDLES AND VALVES

CROSS-REFERENCE TO RELATED APPLICATIONS

This application claims priority to U.S. Provisional Patent Application No. 62/869,207, filed Jul. 1, 2019.

TECHNICAL FIELD

A tool to assist in the operation of water flowing from a spigot needs to do more than just turn faucet handles.

BACKGROUND

Homeowners, condominium owners, apartment dwellers, and commercial building maintenance workers are frequently faced with the task of grasping and turning outdoor faucet handles. Whether it is work related, gardening, watering the lawn, washing the family auto, or simply spraying the kids and the dog, water users want pain-free, hassle-free access to water which is directly related to the operation of faucet handles and valve levers.

Most outdoor faucet handles are categorized into one of three designs: the windowed design, the tee design and the cross tee design; all of which can be difficult to grasp and turn, especially if they are rusted or corroded with sediment. In addition, many outdoor faucets are equipped with water splitters, diverters that channel water into a number of different hoses. The splitters, operated by tiny valve levers, compound the problem of access to water because they too are difficult to grasp and turn.

The relatively simple task of providing water through faucets and hoses can be challenging for many with average strength and dexterity because of the size, shape, and condition of the faucets, handles, and levers. Many others with limited use of their fingers, hands, and arms including those afflicted with arthritis and other conditions that weaken the limbs have an even greater challenge. For them, the task can be frustratingly painful, even impossible.

The Americans with Disabilities Act Accessibility Guidelines (ADAAG) recommend that living accommodations be made to avoid common barriers to operating door handles and other handles likely to be encountered in typical living situations. This standard requires that hardware be operable without any tight grasping or strenuous twisting motion. They stated: "Handles, pulls, latches, locks, and other operating devices on accessible doors shall have a shape that is easy to grasp with one hand and does not require tight grasping, tight pinching, or twisting of the wrist to operate. Lever-operated mechanisms, push-type mechanisms, and U-shaped handles are acceptable designs".

In the spirit of the ADAAG recommendations for door handles, the multipurpose tool presented herein is designed to circumvent the difficulties associated with operating outdoor faucet handles and splitter valves levers. This tool is also designed to aid the user in making simple repairs to eliminate many leaks associated with hose connections.

A small number of tools were intended to engage and rotate the handles of exterior water faucets. Current designs and implements to facilitate the operation of outdoor faucets include covering each faucet handle with a semi-permanent elastomeric surface cap (U.S. Pat. No. 4,999,875), or a plastic cover (U.S. Pat. No. 5,495,641A), or covering a tee (T) handle with a plastic accessory (WO1998001693A1), or using a metal tool atop a tee handle (GB2327255A; U.S. Pat. No. 3,010,346A), or installing a semi-permanent ear-type extended handle (U.S. Pat. No. 6,186,475B1). Some other tools were designed to be portable in their operation. For example, one tool includes 8-12 sliding pins to fit into an outdoor or onto an indoor faucet handle (WO1999005581A1). The pins, falling by gravity, would fit into open areas in and around the handle as the paddle-like pin device contacted the target. With pins in place, the operator would then rotate the handle to open or close the faucet. Other portable tools include fixed pins protruding into open spaces between spokes in a valve handle (JP2008290224A; U.S. Pat. No. 6,378,401B1), and a three-pronged wire device with a long handle to penetrate the windows of faucet handles (U.S. Pat. No. 1,569,638A).

Two marginally related pin-tools designed to turn valve handles had more than one function. The first was designed as a large industrial tool with two pins for sizable valve wheel handles (U.S. Pat. No. 6,076,435A). The second multipurpose tool was designed to fit and work on gas cylinder handles (U.S. Pat. No. 6,450,069B1).

Criticisms of the tools described in the prior art include one or more of the following: limited function, installation cost, effort to operate, and lack of portability.

Plastic covers positioned on top of handles may reduce physical contact with small and sharp metal structures, but they do not provide much leverage for turning, the problem many people with arthritis and other physical impairments must overcome. Extended handles for the tee style are either stationary or portable, but limited to the tee handle design. Single ear-type covers for round windowed handles must be attached to each unit thus adding to the overall effort and cost.

One tool having multiple movable pins (WO1999005581A1) is awkward to set into position, needs gravity to function, requires higher maintenance for the pins to slide smoothly, and is likely to jam multiple pins inside old rusty handles making it difficult to release the tool when turning is complete. Other tools sharing the pin feature have fixed pins (US20090320651A1; U.S. Pat. No. 2,086,722A; US20030047041A1) or wires (U.S. Pat. No. 1,569,638A) that fit in between handle spokes, but lack the two finger simplicity, the light weight, and the versatility of the tool proposed herein. Furthermore, the pin-tool designs described thus far in this paragraph are limited to the singular function of turning handles. Two other pin-tools with multiple functions were designed either to fit and operate large industrial wheel valves and barrel plug nuts (U.S. Pat. No. 6,076,435A), or to fit and operate gas cylinder valves (U.S. Pat. No. 6,450,069B1), neither of which was designed for small outdoor water faucets, splitter valves levers, or to repair leaks.

SUMMARY

A tool to assist in the operation of water flowing from a spigot needs to do more than just turn faucet handles. It should be versatile, lightweight, portable, and comfortable to use. The versatile multipurpose tool described herein is lightweight (3.80 oz or 107 g fully loaded with supplies), and portable. It is able to enter into or straddle and turn a plurality of faucet handles using only two fixed pins, then exit with ease, to turn faucet splitter valves on and off, to tighten or loosen handle nuts, to remove damaged rubber washers, and to smooth rough metal surfaces with its file arm that also generates substantial turning force (torque). Finally, the multipurpose tool in the present application includes a hollow handle that is furnished with plumbing supplies to repair leaks onsite.

DETAILED DESCRIPTION

Figure 1:
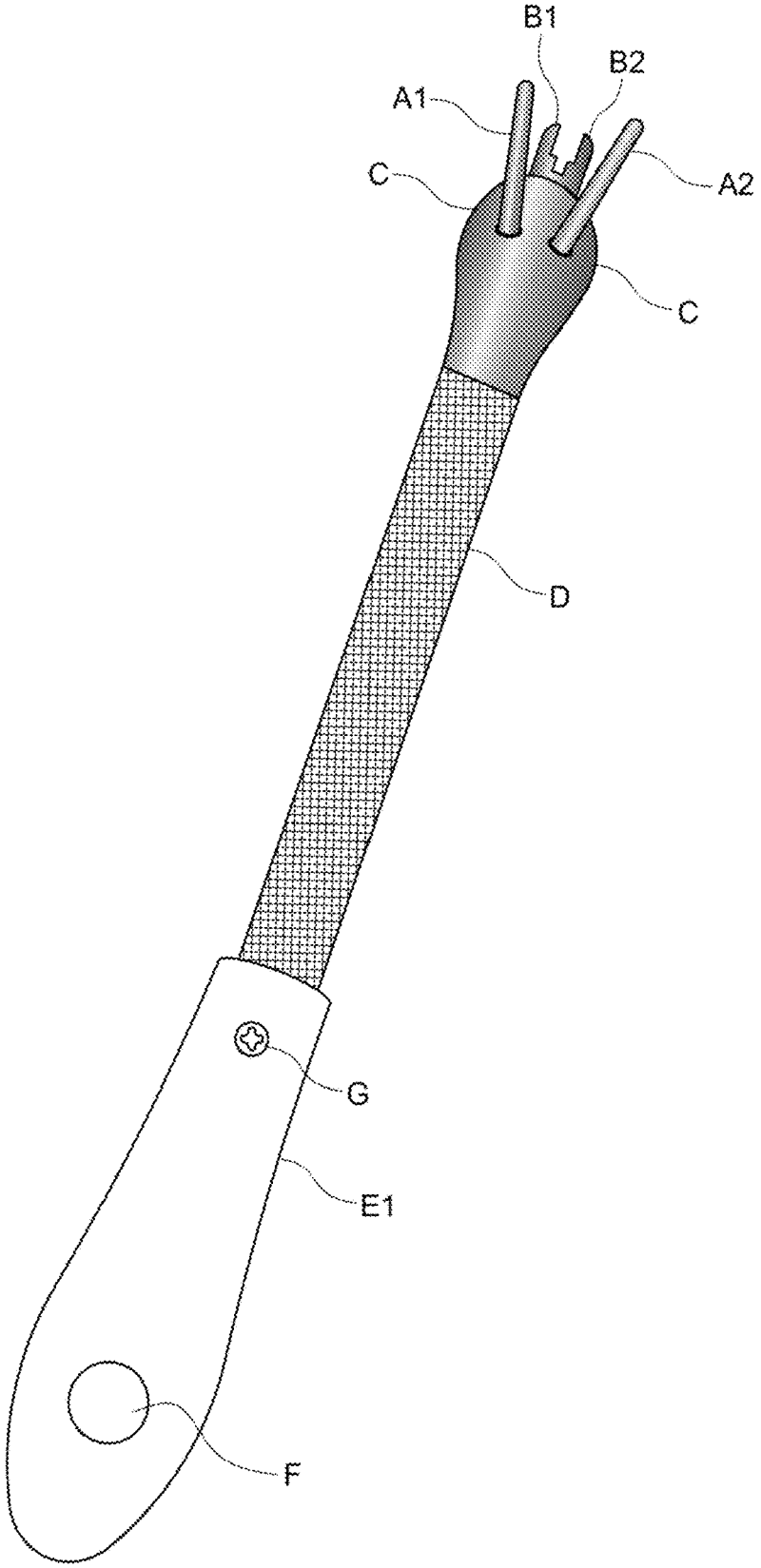
FIG. 1: Top view of the entire multipurpose tool for handles and levers.
Figure 4A:
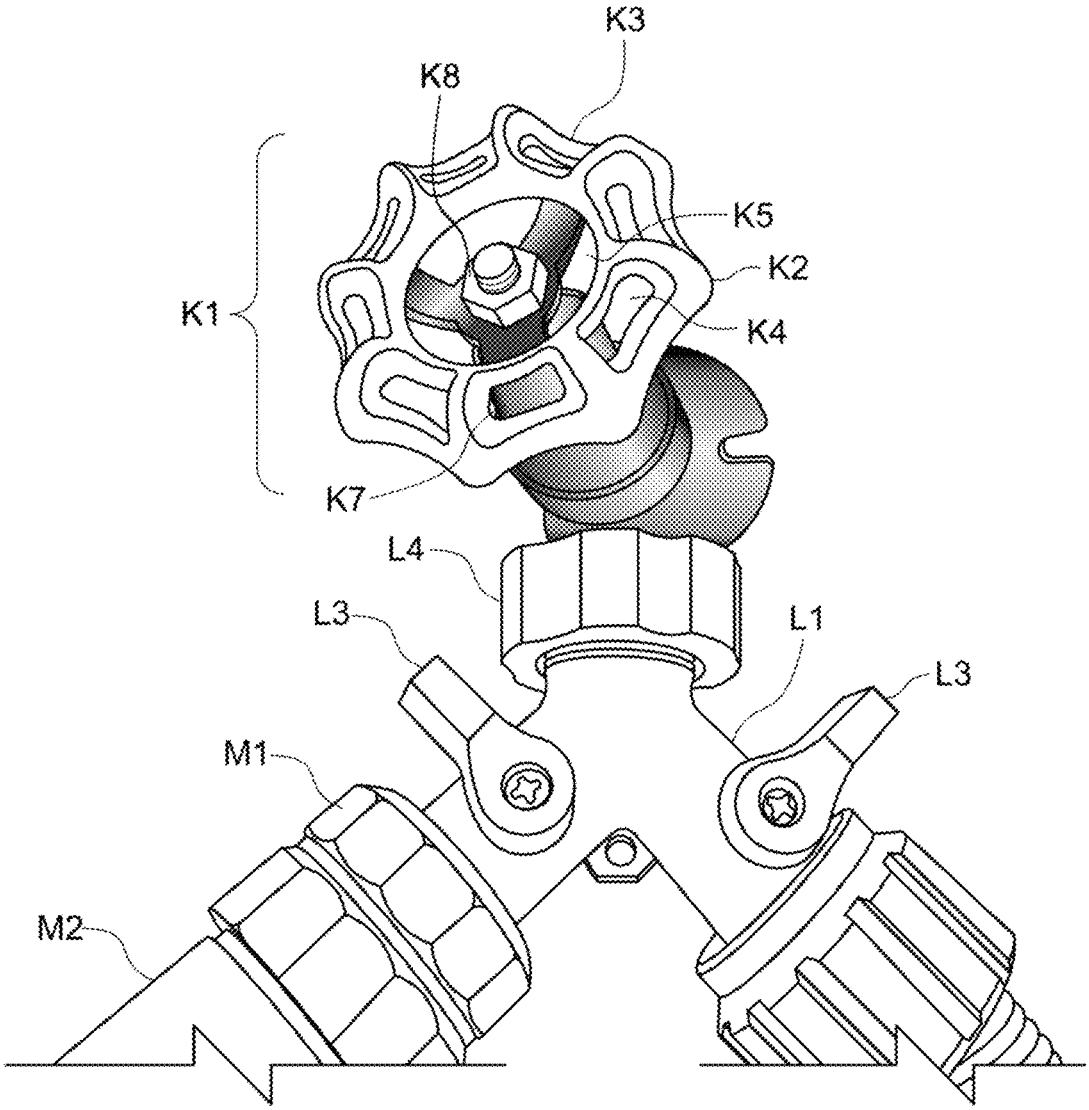
FIG. 4A: View of typical outdoor domestic water faucet with handle, and water splitter with two hoses attached.
Figure 7A:
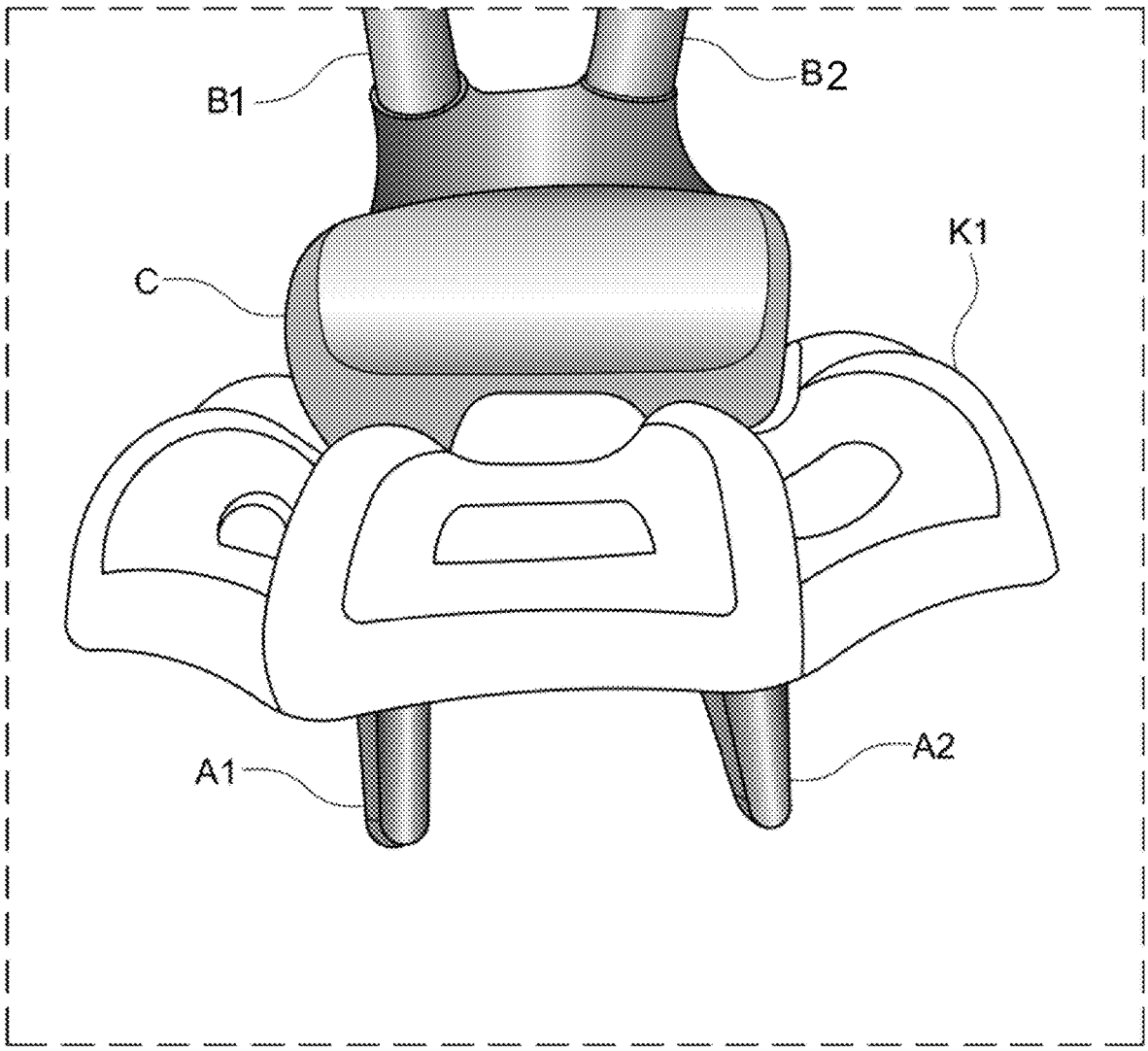
FIG. 7A: Frontal view of the faucet fingers A1, A2 penetrating inner windows of a faucet handle.
Figure 7B:
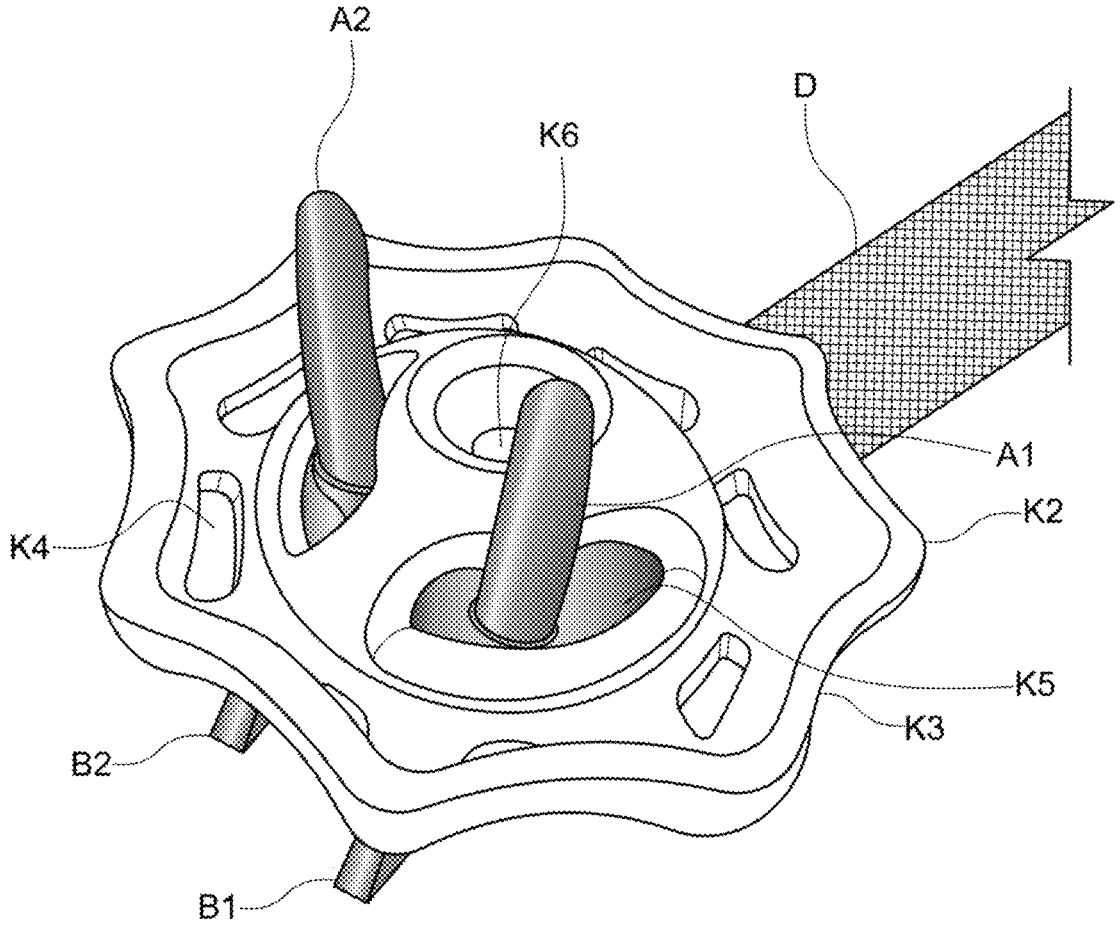
FIG. 7B: Underside view of faucet fingers A1, A2 penetrating inner windows of a faucet handle.

The multipurpose handle and valve tool FIG. 1 will enable most users, including those with reduced strength or arthritic joints, to turn the handle of an outdoor water faucet for lawn, garden, and other purposes. Traced back over many decades, standard metal faucet handles with windows FIG. 4A, K1 have been designed with ridges K2, K3 for human fingers, but are small, sharp, and sometimes slippery making them difficult for users to grip and turn. The basic faucet fingers two-tine structure FIG. 1 and FIG. 2A, A1 and A2 will slip easily into the faucet handle inner windows FIG. 7A and FIG. 7B, K5, or outer windows FIGS. 4A, K4 and K7, and work with the tool arm FIG. 1 and FIG. 2A, D as a lever to generate substantial turning force (torque). With a slight twist of the hand, wrist, or arm, the operator can easily open and close the most resistant outdoor faucets even after negligible use over months or years. In addition to the basic handle-turning function described for older windowed handles found outside of most homes today, the tool, because of its simple two pin (finger) design, can also be used to turn a plurality of newer window designed handles, larger handles, Sharkbite handles, oval handles, and broach handles, plus standard cross handles, and tee faucet handles.

Figure 2A:
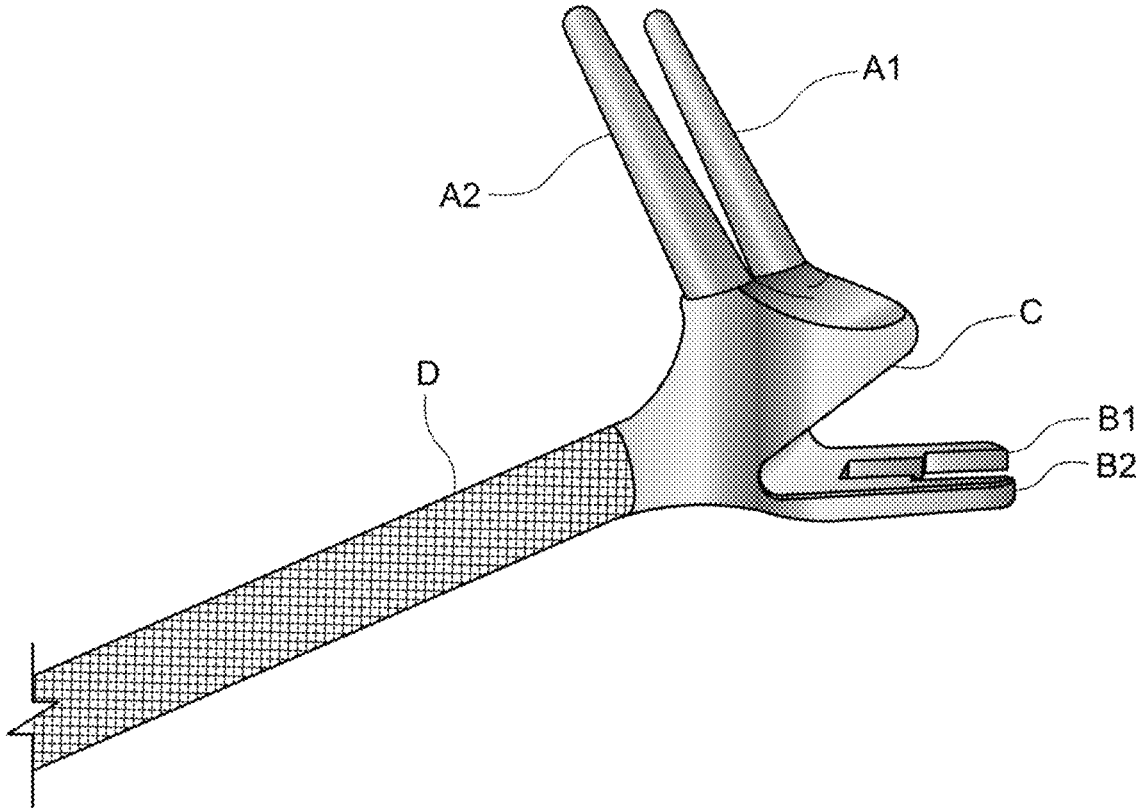
FIG. 2A: Side view of the faucet fingers and the valve fingers attached to the file arm.
Figure 2B:
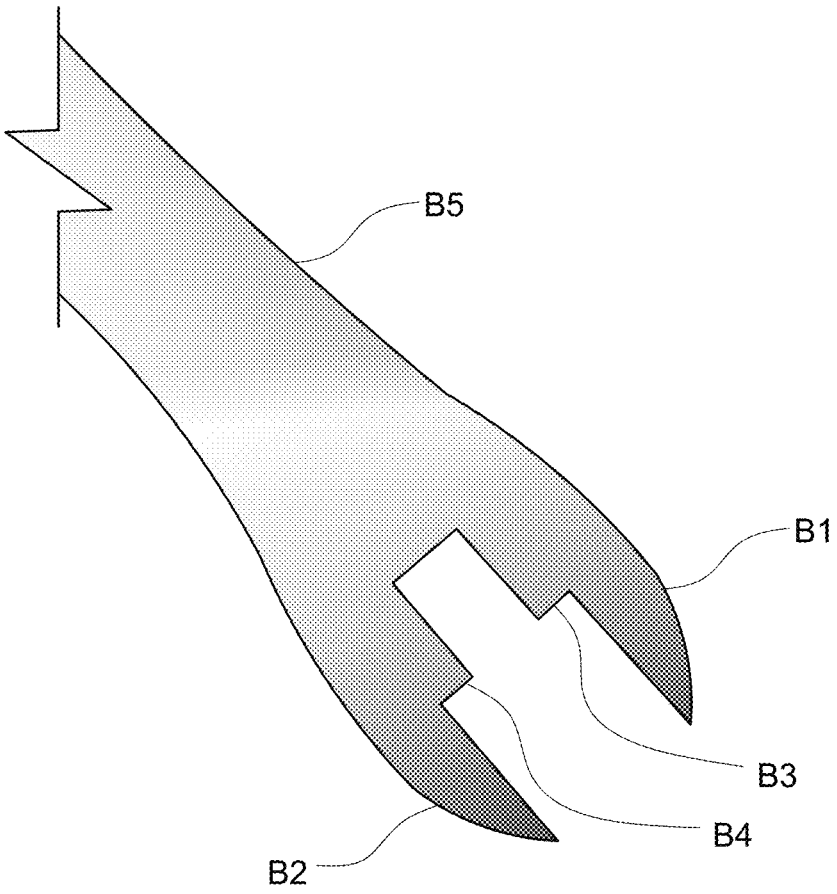
FIG. 2B: Frontal view of the four valve fingers.
Figure 6A:
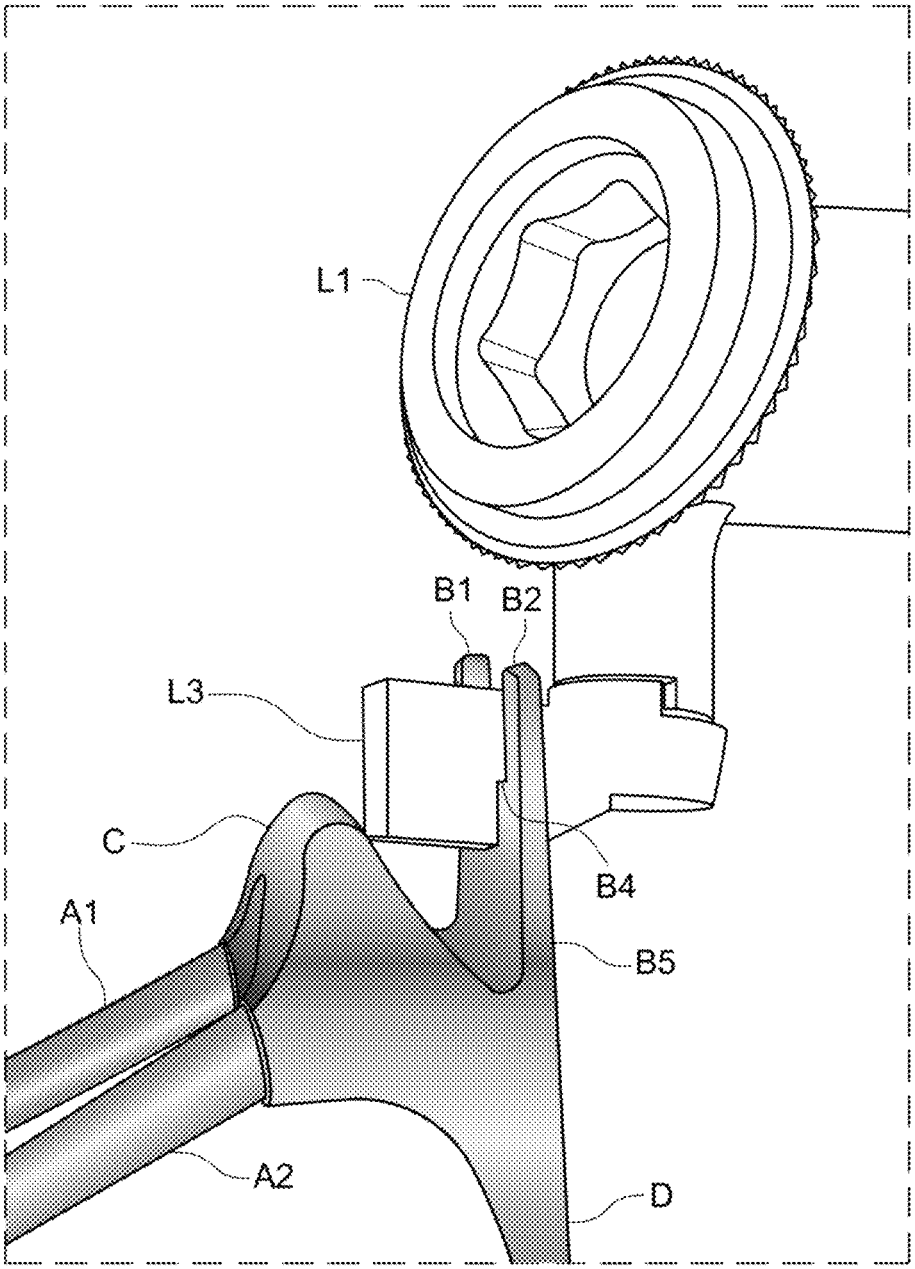
FIG. 6A: Short valve fingers B3 (hidden) and B4 surrounding slim valve lever L3.
Figure 6B:
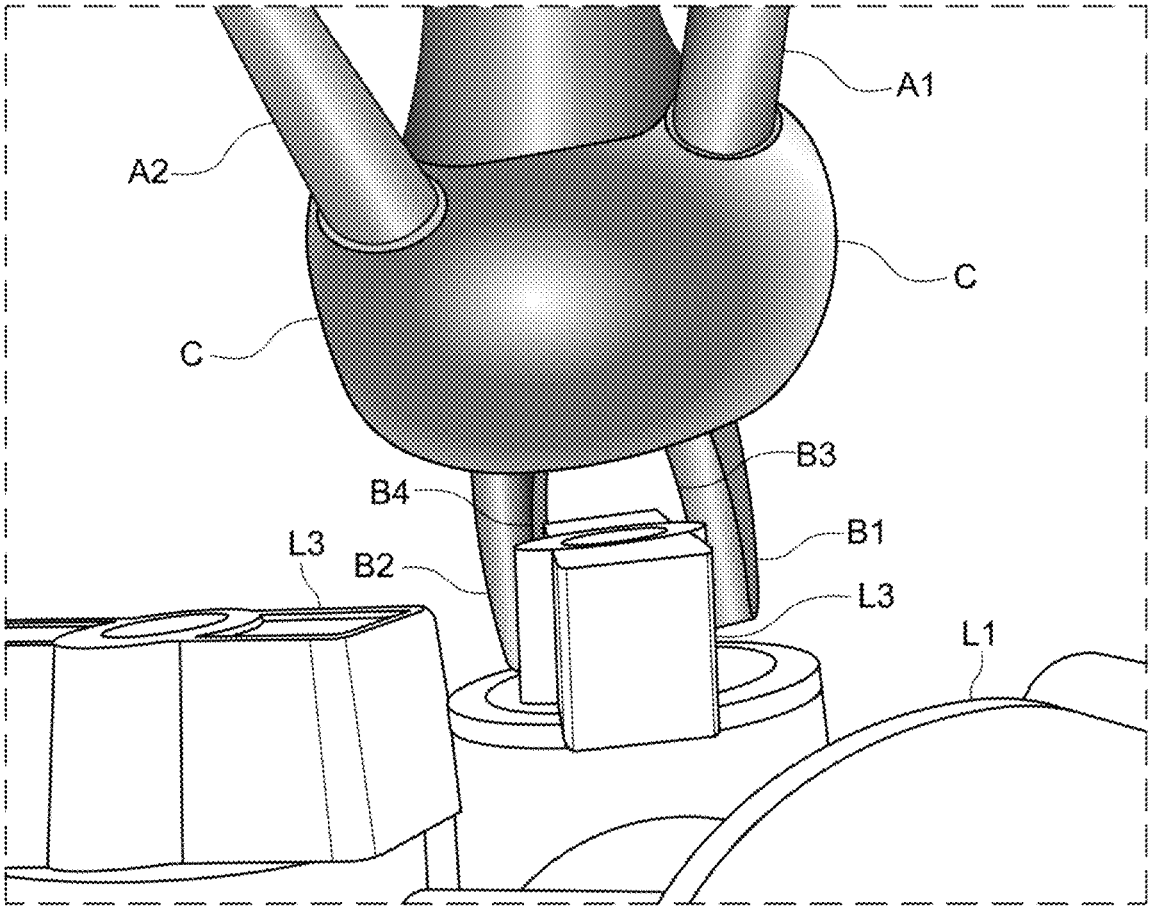
FIG. 6B: Valve fingers B1 and B2 surrounding the wide valve lever L3.
Figure 7C:
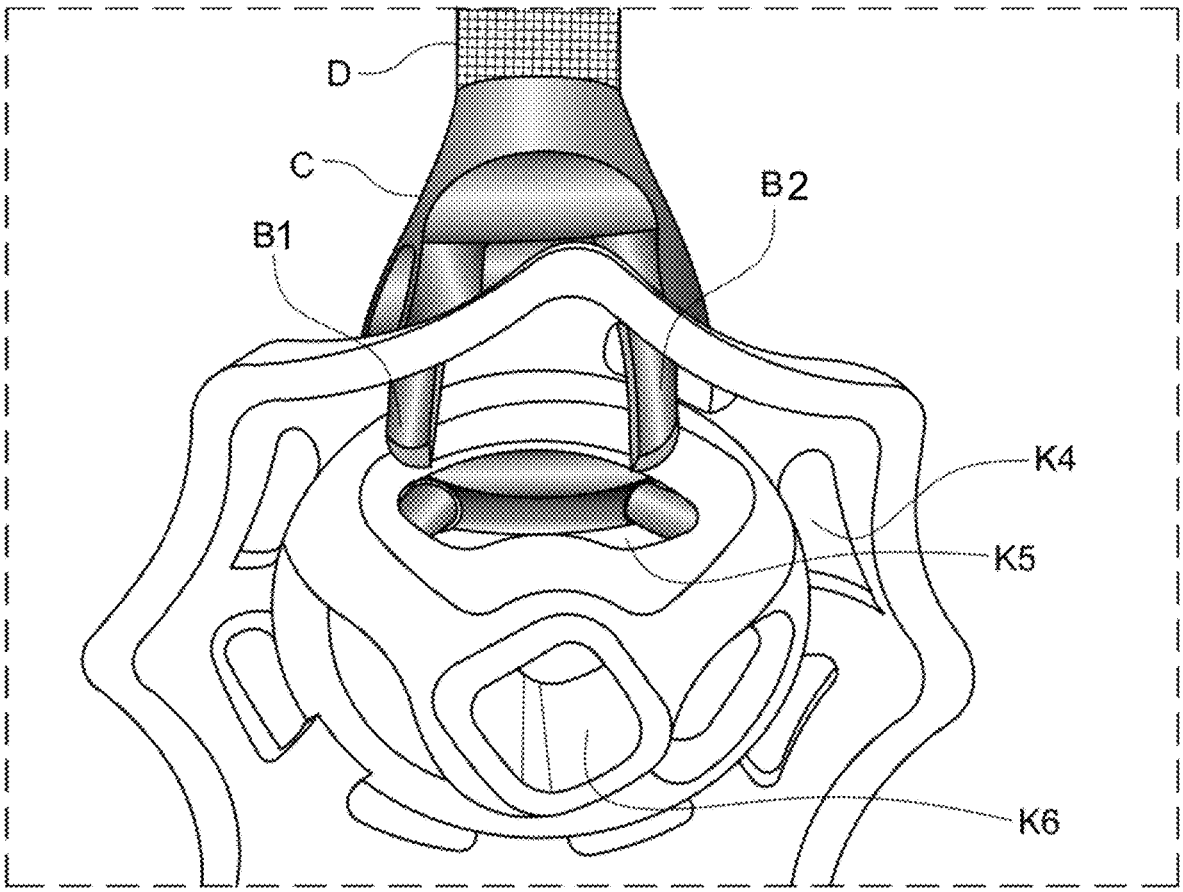
FIG. 7C: Underside view of the valve fingers B1, B2 penetrating outer windows a faucet handle.

The second feature of the multipurpose tool includes the valve fingers FIG. 2A and FIG. 2B, B1, B2, B3, B4 located on the reverse side of the faucet fingers. This feature is designed to easily open and close windowed faucet handles FIG. 7C, and shutoff valves of splitters for multiple hoses FIG. 4A and FIG. 4B, L3 often found attached to an exterior faucet FIG. 4A. The four valve fingers FIG. 2B, B1, B2, B3, B4 of this unique versatile tool will easily fit around and turn most splitter valve levers including the standard rectangle shapes FIG. 6A and FIG. 6B, L3 the teardrop and dumbbell shapes, the diamond wedge shape, and many others.

The third feature of the multipurpose tool is to loosen or tighten the faucet handle nut to facilitate handle tightness or replacement. The valve fingers FIG. 2B, B1 and B2 function as a wrench that will fit most faucet handle nuts FIG. 4A, K8 mounted on top of valve stems.

Figure 4B:
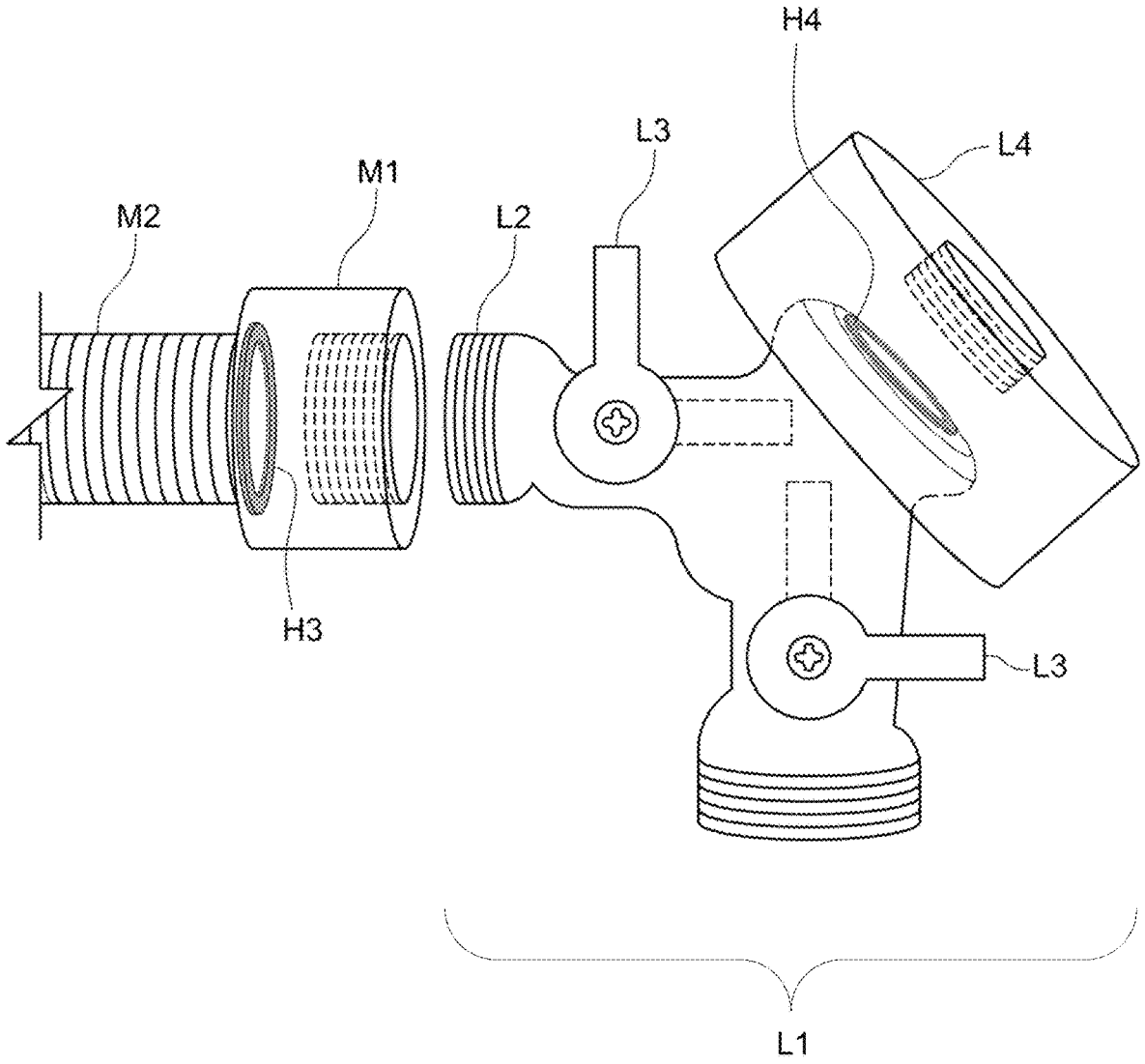
FIG. 4B: Garden hose M2 with rubber washer H3 in base of female connector M1, and water splitter L1 with rubber washer H4 in base of threaded female connector L4, plus threaded male spout L2 exposed without sealing tape. Splitter valve levers L3 are displayed in closed position.

The fourth feature of the multipurpose tool is to use either the valve fingers or faucet fingers to scoop out damaged washers FIG. 4B, H3 and H4 lodged in garden hoses FIG. 4B, M1, and splitters FIG. 4B, L4.

Figure 5A:
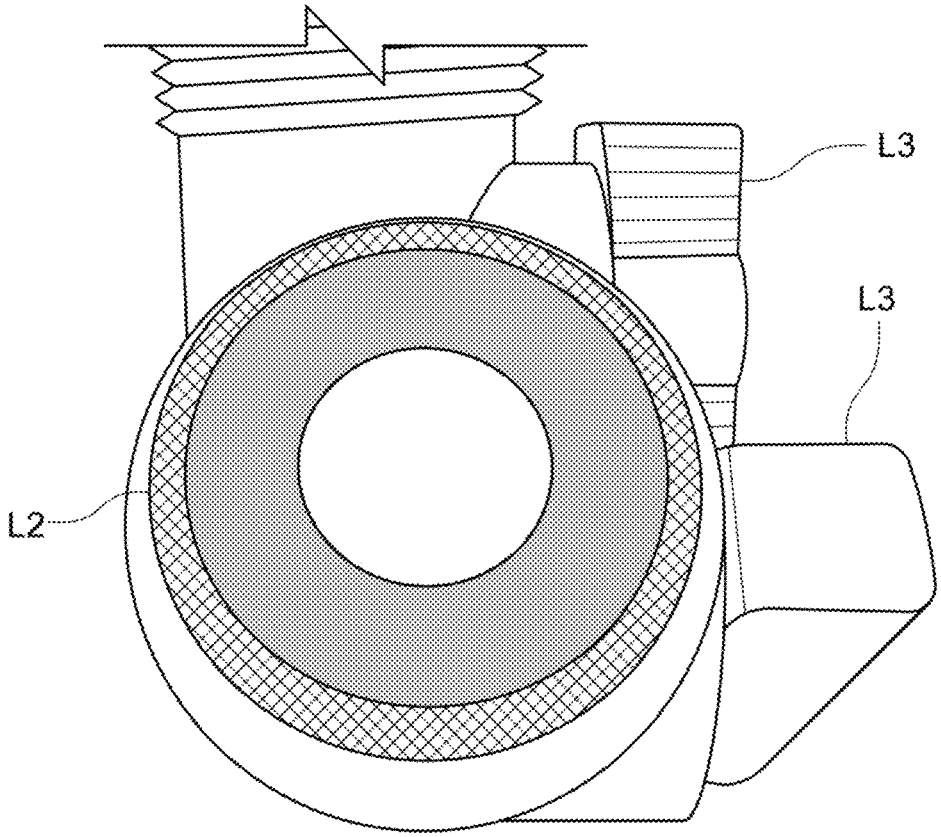
FIG. 5A: Rough lip of threaded male splitter spout L2.
Figure 5B:
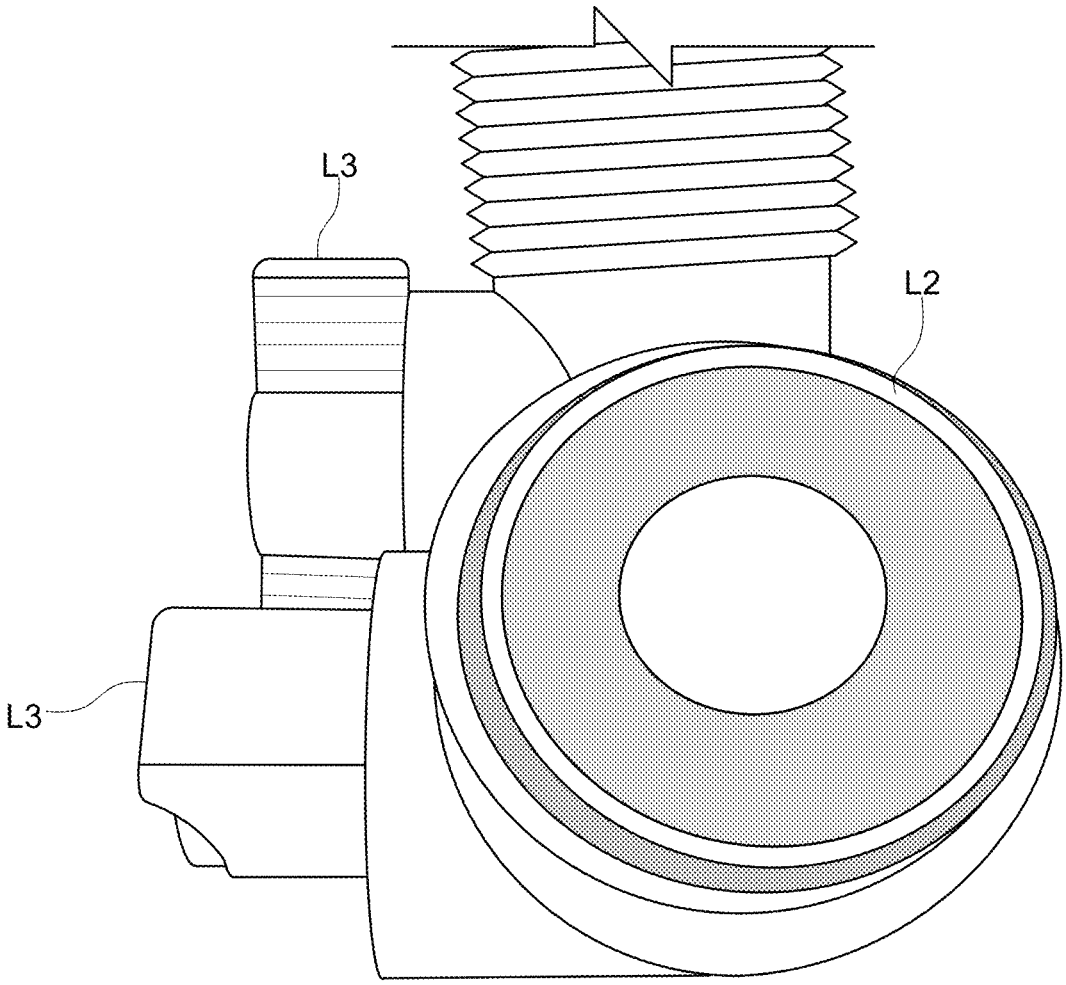
FIG. 5B: Smooth lip of threaded male splitter spout L2 after filing with the tool arm D, not in view.

The fifth feature of the multipurpose tool is the file-style extension arm FIG. 1, D. Although faucet splitters offer the advantage of multiple hose attachments, they tend to leak, not so often at the valve, but near the rubber washers. To reduce and often stop the leaking problem, the tool includes a fine metal file on the surface of the arm. With a few easy strokes against the threaded male splitter FIG. 5A, L2 or faucet rim, the surface often rough and pitted can be smoothed FIG. 5B, L2. The smooth rim tightened against any rubber washer whether at the splitter-to-faucet junction FIG. 4B, L4 or hose-to-splitter junction FIG. 4B, M1 onto L2 will make a watertight seal often ending pesky leaking problems.

Figure 3A:
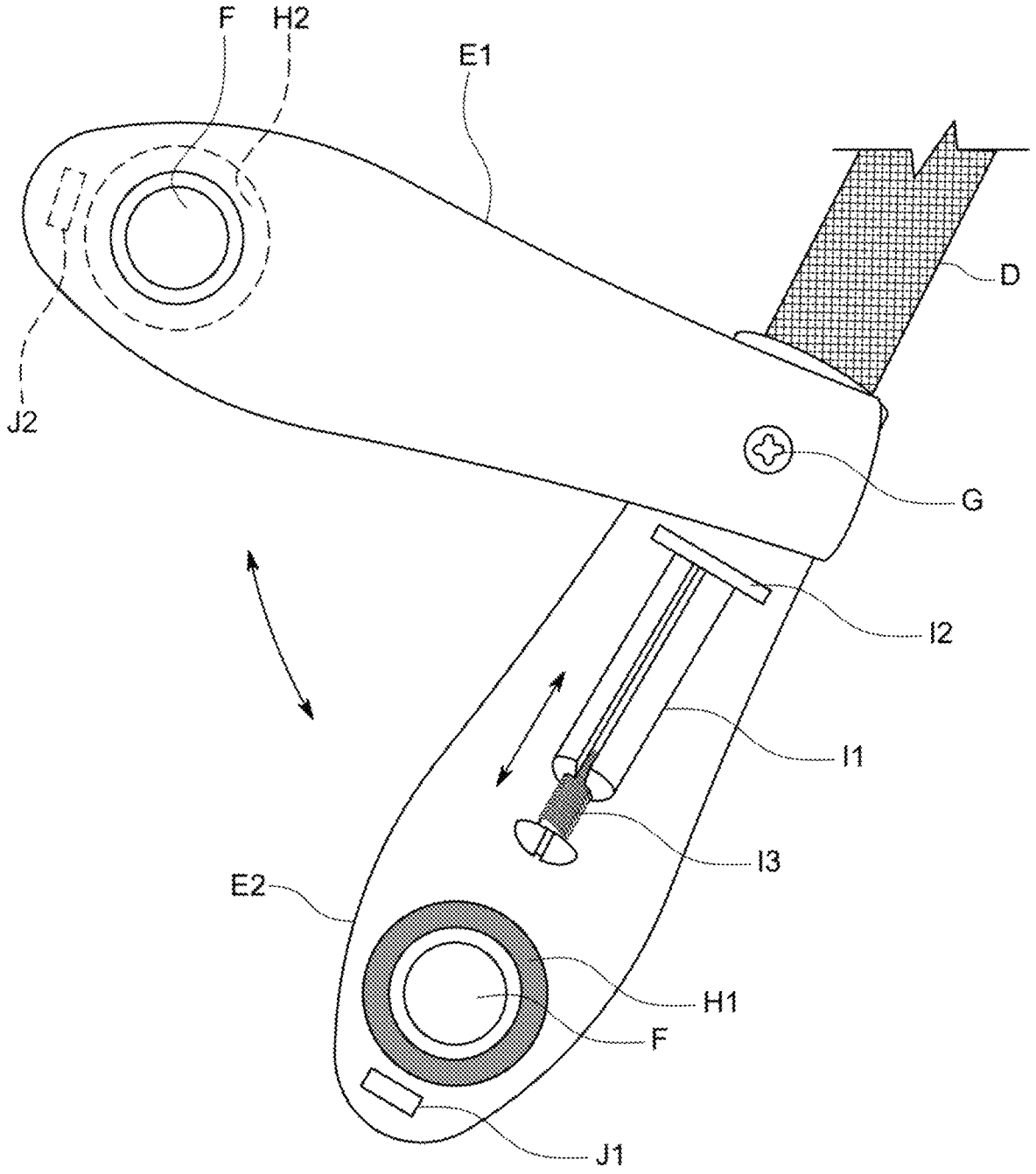
FIG. 3A: Top and inside view of the storage handle opened attached to the file arm.
Figure 3B:
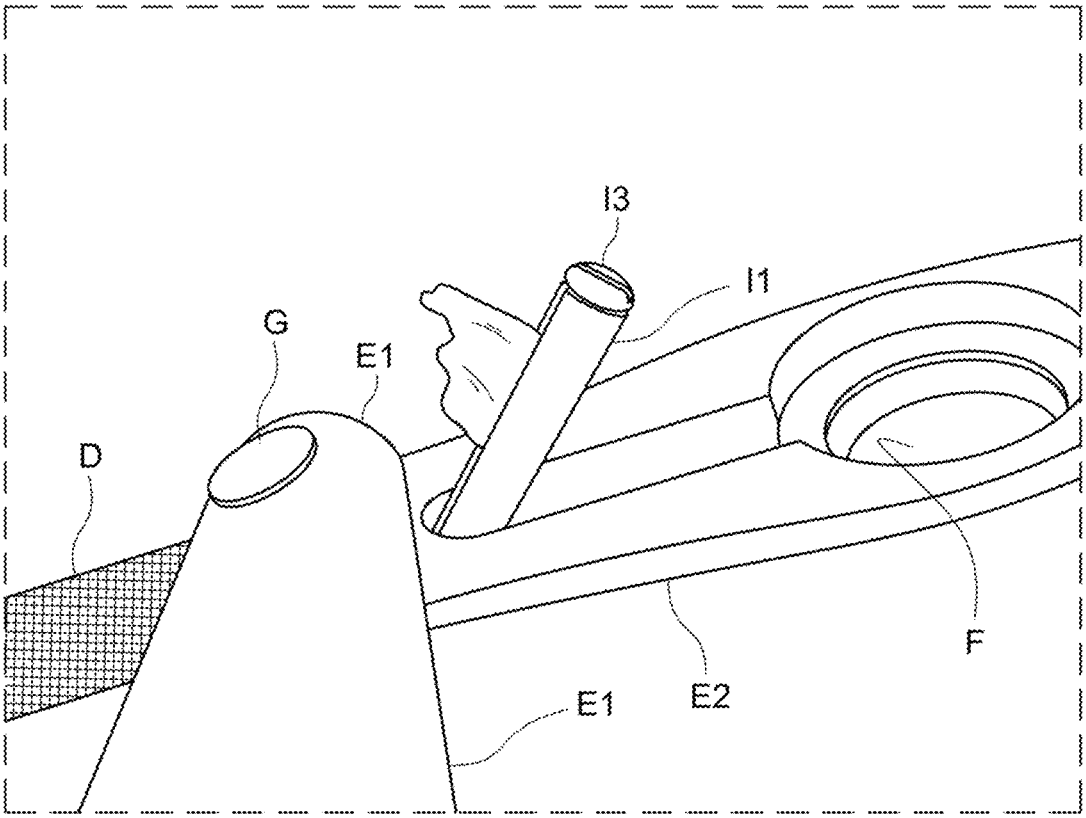
FIG. 3B: Side view of the storage handle opened with sealing tape emerging from elevated tape dispenser 11, 13 and empty washer trench revealed around tool storage hole F.

The sixth feature of the multipurpose outdoor faucet tool is the unique storage handle FIG. 3A and FIG. 3B. One half-handle E1 has been designed to swivel open revealing extra plumbing supplies. Sealing tape from a unique dispenser FIG. 3A and FIG. 3B, 11 and 13 is included to wrap bare faucet threads FIG. 4B, L2, and stem threads. The handle also contains two new standard rubber washers FIG. 3A, H1 and H2 for onsite faucet and hose repairs.

Overall, this multipurpose tool will be a handy, valuable asset for most homeowners and others who have struggled to operate and maintain water flow from outdoor faucets, splitters, and hoses.

EXAMPLES

MATERIALS were obtained from a hardware store.

A. FAUCET FINGERS: FIGS. 1 and 2A. Two steel rods were cut from ceiling hooks (length=1 "½", diameter 5/32", Ace Hardware, #5008016, China).

B. VALVE FINGERS: FIGS. 1, 2A, and 2B. One rectangfliular flat piece of steel was used (length=1½", width=½", thickness=3/32").

C. TOOL ARM: FIGS. 1, 2A, and 3A. One rectangular flat, fine file made of steel was used (Nicholson Hand Tools, USA: length=6", width=½", thickness=3/32"), plus the plastic handle from the original file was fitted over the non-finger end (length=3¾", diameter=1¼"). Total length of the unit: 9½". The tool arm material may vary. The method of attaching the fingers to the tool arm will depend on the nature of the finger and arm material. It may contain stiff metal and or aluminum welding material, epoxy like glues, plastics like Bondo (body filler, 3M Company, USA), or variety of adhesives and other materials.

D. HANDLE: FIGS. 1, 2A and 3A. One plastic handle (Nicholson Hand Tools, USA: length=3¾", diameter at distal tip=1¼", arm shaft end, proximal tip=9/16", a hole for storing was present F). The plastic handle for gripping safety, comfort and storage was removed from the original file tool then later, after modifying the design, was reattached to the arm shaft at the opposite end of the finger tool.

One binding post rivet (aluminum 8-12×¾" Ace Hardware, USA) was used as the handle axle G. Other hardware may substitute. Standard red rubber hose washers (diameter=1.0", Ace Hardware, #74129, China) were selected as supply material. Other hose washers may substitute. One slotted tension pin tube (¼", length=1⅛") was selected to house the sealing tape. Other hardware may substitute. One roller pin (round head screw top=¼", length=1.0") had its shaft ground smooth to 1/16" diameter to hold the sealing tape. Other hardware may substitute. Sealing tape (PTFE Thread Seal Tape: mil. T-27 730A, ½", Magic Mounts, China, or Teflon Tape of same dimensions) was selected as supply material. Other sealing tapes may substitute. Liquid plastic (Bondo body filler, 3M Company, USA) was used to fill gaps and secure parts. Other epoxies or plastics or filling material may substitute. The handle material may vary in size, texture, shape, and color.

Assembly:

A. FAUCET FINGERS: Two steel rods FIG. 1 and FIG. 2A, A1, A2 were cut to 1½" length and bent into an "L" shape: finger length=¾" and base length=¾". Each base was ground square, clamped together and spread apart by ¾" at the fingertip centers, then spot-welded (MIG welder) together to form a staple-shaped bracket.

B. The welded rod bracket was checked for fitment into faucet handles, centered on the tip of the tool arm FIG. 1 and FIG. 2A, D, then welded onto the top side of the flat steel arm tip C perpendicular to the tool arm D. Other angles for mounting the bracket may be used as well.

C. VALVE FINGERS: The flat iron base FIG. 2B, B5 was bent to approximately 30 degrees leaving a 1¼" straight flat extension which was hollowed out into fingers at the tip. Two rectangular slots were cut out of the tip. The first center slot cut was 4/16" deep and 7/16" wide. The second center slot cut was an additional 5/16" deep and 4/16" wide. This resulted in two notched limbs, 4 valve finger tines FIG. 2B, B1, B2, B3, B4, extending from the outer tip of the flat iron B5. Other more specific finger shapes to fit valve levers are possible. The valve finger tines B1 and B2 also fit the faucet handle nut FIG. 4A, K8 for easy removal.

The valve fingers base FIG. 2B, B5 (length=¼") was centered on the bottom side of the arm tip C, then welded in place. Other finger materials may require other forms of attachment to the arm. As a result, the valve fingers extend ¼" beyond the tool tip hub C (central welding area) and point downward at approximately a 30 degree angle from the flat steel arm D. Other angles and extension lengths from the arm may be used. The welds and fingers were ground smooth and gaps in the welds were filled with a sturdy plastic (Bondo body filler, 3M Company, USA). The welded, smoothed hub C was painted black to preserve the metal and provide a uniform appearance. Other methods of adhering the fingers to the arm and fillers are possible depending on the finger and arm materials.

D. TOOL ARM: The tool arm FIG. 1, D connecting the handle with the faucet and valve fingers has a fine-file surface on both sides.

E. HANDLE: One plastic handle (Nicholson: length=3¾", tip diameter=1¼", arm shaft end=11/16") FIG. 1 after separation from the file tang was ripped in half the long way from the arm attachment to opposite tip resulting in two mirror-image half-handles FIG. 3A and FIG. 36, E1, E2. One hole was drilled near the arm end (distance: ⅜" from the handle tip) through both half-handles and the arm heel D to accommodate a binding post rivet G which allows one handle halve to swivel around the rivet shaft forming open and close positions. One half-handle was hollowed out in the shape of the file heel (length=⅝", depth=⅛") minus its file tang that was removed. The heel of the file arm was permanently embedded in the handle trench with liquid plastic (Bondo body filler, 3M Company, USA) and allowed to firm up. A hole to accommodate a rubber washer FIG. 3A and FIG. 3B was drilled on the inside of each half-handle at the opposite end of arm rivet G. Each hole, located ¾" from the tip, was bored using a 1.0" drill bit that sunk to a depth of ¼". Each hole is used to house one washer H1, H2 (standard red rubber hose washer, diameter=1.0", Ace Hardware, #74129, China) for a standard garden hose FIG. 4B, M1, H3 or splitter L4, H4. A single trench was drilled out of the center of one half-handle FIG. 3B (length=1¼", width=5/16", depth=⅜") to accommodate a dispenser 11 for thread-sealing tape (PTFE Thread Seal Tape: mil. T-27 730A, ½", Magic Mounts, China, or Teflon Tape of same dimensions). The tape dispenser 11 was manufactured from one ¼" slotted tension pin tube (length=1⅛"). A small round metal bar (length=½", width=⅛") was welded onto one end of the tension pin tube forming a tee pivoting anchor bar FIG. 3A, 12 with the open slot of the tube 11 facing outward 90 degrees from the pivot tee bar 12. The shaft roller pin FIG. 3A and FIG. 36, 13 (round head screw top=¼", length=1.0") was ground smooth to 1/16" diameter. The pin was designed to hold the thread-sealing tape (length=8-10") wound onto its surface and placed into the top end of the sealing tape dispenser 11. During insertion, the free outer end of the wrapped tape (length=¼") was threaded through the tension pin slot to allow the user to grasp the tape like the end piece of toilet paper on a roll. Pulling on the tape causes the pin to spin inside the dispenser releasing tape as needed. After fitment of dispenser parts, liquid plastic (Bondo body filler, 3M Company, USA) was used to anchor the pivoting tee bar 12 at the arm shaft end of one half-handle. Rotating the tape dispenser 11 up and down along the tee bar axis in the half-handle trench while the plastic hardened permitted the tape dispenser to rotate freely on a permanent basis after the plastic cured fully. As a result, the anchored tape dispenser 11 can rotate up from the half-handle trench for future tape refills, or lie flat in the half-handle trench to release sealing tape. Liquid plastic (Bondo body filler, 3M Company, USA) was used to fill extraneous holes and gaps in the tape dispenser trench and washer trenches. Finally, one small "speed bump" ridge FIG. 3A, J2 (Bondo: length=½", width=¼", height=¼") was installed at the tip of half-handle E1 and a reciprocal trench J1 (length=½", width=¼", depth=¼") was carved out of half-handle E2 as a fastening design to keep the handle halves closed during routine finger operations. The end result is a storage handle that swivels open to expose extra rubber washers and thread-sealing tape for servicing external faucets. After extracting needed plumbing material, the movable half-handle swivels closed for regular faucet fingers and valve fingers functions. All materials taken from the handle can be replenished at a later date. Alternative materials for all structures and parts described in the basic mode of this application are subject to manufacturing efficiencies.

F. STORAGE DEVICE: The multipurpose tool has a hole in the handle FIG. 1, FIG. 3A, and Fig. B, F (diameter=½") which can be used to hang the unit on a hook, peg, or other extending structure that is located at the faucet site or elsewhere.

ALTERNATIVE EMBODIMENTS: Be it understood that the drawings and descriptions of the multipurpose tool in its basic mode illustrate the principles and elements of the invention. More elaborate iterations, changes, additions and alterations of the various elements to achieve like results may proceed without departing from the spirit of the invention or the scope of the recorded claims.

All materials listed above in the basic mode can be substituted by materials of comparable strength, flexibility, and durability suitable for a tool of this nature.

All materials listed above in the basic mode can be substituted with other comparable materials that differ in color, size, and texture.

All joining and filling materials listed above in the basic mode can be substituted by other materials of equal strength, flexibility, and durability compatible with the type of material to be joined.

The arm length, size, and shape listed above in the basic mode can vary. It can contain one or more separate wrench arm extensions made of metal or strong durable materials that are fixed in position or that fold, swivel, slide, or in some manner move into or lock into a functioning position. The purpose of one wrench is to tighten or loosen the packing nut K7 that surrounds and seals the faucet stem under the faucet handle.

The handle length, size, and shape listed above in the basic mode can vary. The handle can have one or more additional trenches to house other supplies including but not limited to washers, O-rings, plumbing plugs, screws, bolts and nuts plus other fasteners and water sealing materials, and other small plumbing necessities.

The tape dispenser listed above in the basic mode can vary in external and internal size, shape, length and other dimensions.

The storage hole F in the tool handle listed above in the basic mode can be accompanied by a storage strap, anchored near or through the hole, that consists of but not limited to various lengths of materials made of rope, hemp, twine, leather, nylon or other synthetic materials, or other flexible and non-flexible materials.

The faucet fingers and valve fingers listed above in the basic mode can be modified by allowing each or both sets of fingers to swivel, slide, rotate, or in some other way move into their functional positions from a storage or traveling position.

The faucet fingers and valve fingers listed above in the basic mode may be attached to or incorporate a pliers or channel lock device.

The arm listed above in the basic mode may be part of a pliers handle, wrench or other tool handle.

The faucet fingers listed above in the basic mode can be made from small screwdrivers, one standard and one Philips using the same dimensions as described for the basic mode. The screwdrivers would facilitate the installation and removal of certain faucet handles fastened to the faucet stem with a screw instead of a nut.

The faucet fingers and valve fingers listed above in the basic mode may be folded neatly into a tool resembling a multipurpose pocket knife.

The multipurpose tool listed above in the basic mode can be modified by attaching the faucet fingers to various locations on the arm.

The multipurpose tool listed above in the basic mode can be modified by attaching the valve fingers to various locations on the arm.

The multipurpose tool listed above in the basic mode can be modified by attaching the faucet fingers and valve fingers to a smooth arm without the file surface with the spare parts handle, or with a basic, non-storage handle.

The multipurpose tool listed above in the basic mode can be modified by attaching the faucet fingers without the valve fingers to a smooth arm without the file surface with the spare parts handle, or with a basic, non-storage handle.

The multipurpose tool listed above in the basic mode can be modified by attaching the valve fingers without faucet fingers to a smooth arm minus the file surface with the spare parts handle, or with a basic, non-storage handle.

The multipurpose tool listed above in the basic mode can be modified by attaching the faucet fingers and valve fingers to a file surface ground into one or both sides of the arm with a basic, non-storage handle.

The multipurpose tool listed above in the basic mode can be modified by attaching the faucet fingers without valve fingers to a file surface ground into one or both sides of the arm with the spare parts handle, or with a basic, non-storage handle.

The multipurpose tool listed above in the basic mode can be modified by attaching the valve fingers without faucet fingers to a file surface ground into one or both sides of the arm with the spare parts handle, or with a basic, non-storage handle.

The unique multipurpose tool for handles and valves presented herein is designed to assist with the control of water flowing from typical domestic exterior water faucets. Resistant faucet handles and splitter valves can be turned on and off with little effort. Its rugged steel and ergonomic construction make the multipurpose tool small, lightweight, portable, economical, and easy to use. Just slip the faucet fingers (pins, tines) into the faucet handle inner or outer windows, then rotate the handle to open or close the water valve. The valve fingers (pins, tines) on the flip side of this tool are used to turn valve levers of splitters allowing water to flow into different hoses. The valve fingers also fit most handle nuts for easy tightening or removal of the handle, if needed, and both sets of fingers can be used to scoop out old, damaged rubber washers. The file-style arm can smooth rough metal edges that contact rubber washers, thus reducing leaks. Finally, the storage handle carries extra sealing tape and rubber washers for quick onsite repairs.

LEGENDS

A1: Left faucet finger.
A2: Right faucet finger.
B1: Left valve finger.
B2: Right valve finger.
B3: Left valve short finger.
B4: Right valve short finger.
B5: Valve finger limb.
C: Welded hub.
D: File arm.
E1: Top half of the tool handle swivels on hinge G; spare washer H2, and latch bump
J2 are not visible.
E2: Bottom half of the tool handle contains a sealing tape dispenser 11, 12, 13 and a spare washer H1. This stationary half-handle is firmly attached to file arm D.
F: Tool storage hole through handle.
G: Binding-post rivet hinge.
H1: Rubber washer stored in bottom half of tool handle.
H2: Rubber washer (hidden from outside view) stored in top half of tool handle E1.
H3: Rubber washer set in base of female hose tip.
H4: Rubber washer set in base of female splitter.
11: Sealing tape holder with open slot down the middle.
12: Sealing tape holder pivoting anchor tee bar (hidden in plastic handle E2).
13: Sealing tape holder pin.

J1: Handle closing latch trench.
J2: Handle closing latch bump (hidden).
K1: Typical outdoor window-style faucet handle.
K2: Outer knob of outdoor faucet handle.
K3: Indentation of outer rim of outdoor faucet handle.
K4: Outer window of faucet handle.
K5: Inner window of faucet handle.
K6: Center square hole used to mount handle onto square water faucet stem.
K7: Packing nut used to seal faucet stem.
K8: Locking nut used to secure windowed handle to faucet stem.
L1: Water splitter.
L2: Threaded male end of splitter attaches to the female tip M1 of an extension hose M2.
L3: Valve lever attached to and controlling an internal valve that opens and closes. The lever, as shown perpendicular to the splitter, is in the closed position. Note the completely open position for the valve lever, dashed lines, is parallel to the splitter.
L4: Threaded female end of splitter is used to attach to the threaded male end of outdoor faucet.
M1: Threaded female hose tip to be attached to threaded male splitter end L2.
M2: Hose, typically a garden hose, fixed to threaded female tip M1.

I claim:

1. A multipurpose tool comprising:
an arm defined by a first end and an opposed second end;
an attachment extending from the first end of the arm, the attachment defined by:
a first end in contact with the first end of the arm and an opposed second end distal from the first end of the arm;
a top edge and an opposed bottom edge;
an indentation positioned at the second attachment end that extends inward towards the first attachment end, wherein the indentation divides the attachment into an upper region and a lower region;
a first pair of fingers that extend upward from the top edge of the attachment;
a cutout extending through the lower region positioned adjacent to the second end of the attachment, whereby the cutout creates a second set of four fingers; and
a hollow handle positioned at the second end of the arm, wherein the hollow handle is defined by an upper segment that rotates relative to a lower segment, wherein the lower segment comprises a trench configured to house one or more washers, plugs, O-rings, screws, nuts, bolts, or combinations thereof.

2. The multipurpose tool of claim 1, wherein the arm includes an outer surface file surface.

3. The multipurpose tool of claim 1, wherein the handle comprises storage for sealing tape.

4. The multipurpose tool of claim 1, wherein the first pair of fingers taper as they extend away from the attachment.

5. The multipurpose tool of claim 1, further comprising a second indentation positioned adjacent to the first pair of fingers at the second end the attachment.

6. The multipurpose tool of claim 1, wherein the indentation is defined by a lower edge parallel to the bottom edge of the attachment, and an angled upper edge that extends towards the second end of the attachment.

7. The multipurpose tool of claim 1, wherein the cutout is configured with a first square shape and a rectangular shape extending from a top edge of the square shape.

8. The multipurpose tool of claim 1, wherein the second set of fingers include a pair of fingers with a pointed tip, and a pair of fingers with a squared tip.

9. The multipurpose tool of claim 1, wherein the first set of fingers, second set of fingers, or both are configured to swivel, slide, or rotate.

10. The multipurpose tool of claim 1, wherein the first set of fingers are perpendicular relative to the arm.

11. The multipurpose tool of claim 1, wherein the second set of fingers extend beyond the second end of the attachment.

12. The multipurpose tool of claim 1, wherein the second set of fingers are angled downward at an angle of about 30 degrees relative to the arm.

13. A method of opening and closing one or more faucet handles selected from a windowed design faucet handle, single tee design faucet handle, one or more stem nuts, and cross tee design faucet handle, the method comprising:
providing a multipurpose tool having an arm defined by a first end and an opposed second end, an attachment extending from the first end of the arm, the attachment defined by, a first end in contact with the first end of the arm and an opposed second end distal from the first end of the arm, a top edge and an opposed bottom edge, an indentation positioned at the second attachment end that extends inward towards the first attachment end, wherein the indentation divides the attachment into an upper region and a lower region, a first pair of fingers that extend upward from the top edge of the attachment; a cutout extending through the lower region positioned adjacent to the second end of the attachment, whereby the cutout creates a second set of four fingers; and a hollow handle positioned at the second end of the arm, wherein the hollow handle is defined by an upper segment that rotates relative to a lower segment, wherein the lower segment comprises a trench configured to house one or more washers, plugs, O-rings, screws, nuts, bolts, or combinations thereof;
positioning the first set of fingers to operably engage the faucet handle and applying a torque to the tool arm to rotate the faucet handle, whereby the faucet handle is opened and closed.

14. A method of opening and closing one or more splitter valve levers, the method comprising:
providing a multipurpose tool having an arm defined by a first end and an opposed second end, an attachment extending from the first end of the arm, the attachment defined by, a first end in contact with the first end of the arm and an opposed second end distal from the first end of the arm, a top edge and an opposed bottom edge, an indentation positioned at the second attachment end that extends inward towards the first attachment end, wherein the indentation divides the attachment into an upper region and a lower region, a first pair of fingers that extend upward from the top edge of the attachment; a cutout extending through the lower region positioned adjacent to the second end of the attachment, whereby the cutout creates a second set of four fingers; and a hollow handle positioned at the second end of the arm, wherein the hollow handle is defined by an upper segment that rotates relative to a lower segment, wherein the lower segment comprises a trench configured to house one or more washers, plugs, O-rings, screws, nuts, bolts, or combinations thereof;

positioning the second set of fingers into a valve window and applying a torque to the tool arm to rotate the splitter valve lever, whereby the splitter valve lever is opened and closed.

15. The method of claim 14, wherein the splitter valve levers are selected from one or more rectangle shapes, teardrop shapes, dumbbell shapes, or diamond wedge shapes.

16. The method of claim 13, further comprising the step of removing a damaged washer from a faucet, by maneuvering the first set of fingers or second set of fingers into a washer housing to dislodge a washer positioned therein.

17. The method of claim 13, wherein the arm includes an outer surface file, the method further comprising the step of smoothing a roughened surface, by positioning the file adjacent to the roughened surface and filing the rough surface, thereby smoothing the surface.

* * * * *